US005542203A

United States Patent [19]

Luoma et al.

[11] Patent Number: 5,542,203

[45] Date of Patent: Aug. 6, 1996

[54] MOBILE SIGN WITH SOLAR PANEL

[75] Inventors: Eugene H. Luoma, Duluth; James L. Blesener, White Bear Lake, both of Minn.

[73] Assignee: ADDCO Manufacturing, Inc., St. Paul, Minn.

[21] Appl. No.: 286,675

[22] Filed: Aug. 5, 1994

[51] Int. Cl.[6] ..... G09F 13/00

[52] U.S. Cl. ..... 40/610; 340/908; 40/590; 40/601; 40/612

[58] Field of Search ..... 40/550, 610, 590, 40/601, 606, 607, 612; 340/908, 908.1; 362/183; 116/63 P, 63 R

[56] References Cited

U.S. PATENT DOCUMENTS

| | | | |
|---|---|---|---|
| 4,077,144 | 3/1978 | Smits | 40/590 |
| 4,281,369 | 7/1981 | Batte | 362/183 |
| 4,319,310 | 3/1982 | Kingsley | 362/183 |
| 4,421,943 | 12/1983 | Withjack | 136/246 |
| 4,481,562 | 11/1984 | Hickson | 362/183 |
| 4,486,820 | 12/1984 | Baba et al. | 362/183 |
| 4,947,300 | 8/1990 | Wen | 362/183 |
| 4,977,488 | 12/1990 | Spotts et al. | 362/183 |
| 4,989,124 | 1/1991 | Shappell | 362/183 |
| 5,217,296 | 6/1993 | Tanner et al. | 362/183 |
| 5,253,150 | 10/1993 | Vanni | 362/183 |

OTHER PUBLICATIONS

ADDCO Manufacturing Co., Inc. brochure, front and back side entitled The Best Sign Under the Sun. (Admitted prior art).

*Primary Examiner*—Blair Johnson
*Assistant Examiner*—Cassandra Davis
*Attorney, Agent, or Firm*—Palmatier, Sjoquist & Helget, PA

[57] ABSTRACT

A mobile sign with a solar panel for warning motorists of highway problems. The mobile sign comprises a wheeled vehicle, an electrically powered sign panel mounted on the wheeled vehicle, a chargeable battery for powering the sign panel, and a solar panel for charging the battery. The solar panel is rotatable and tiltable relative to the wheeled vehicle. The sign panel is independently rotatable relative to the wheeled vehicle. The sign panel has a low-glare, high-contrast display that also improves the lifetime of the display's electronic or mechanical components by reducing heating of the display due to the sun.

12 Claims, 4 Drawing Sheets

MOBILE SIGN WITH SOLAR PANEL

BACKGROUND OF THE INVENTION invention relates to a mobile sign with a solar panel, and in particular to a mobile sign wherein the solar panel is tiltable and rotatable relative to the trailer on which the sign panel is mounted. Another aspect of the present invention is a low-glare, high-contrast display.

Highway warning signs are frequently needed to warn motorists of obstructions, traffic delays, and hazardous conditions as such conditions arise. To be most useful, a highway warning sign should be mobile so that the sign may be transported to the site of the obstruction. Once the sign has been moved to the site of the obstruction, the sign may be left along the highway to warn passing motorists.

In order to be visible in a variety of lighting conditions (bright sunlight, overcast, nighttime, etc.) the sign's warning should be illuminated, i.e., the sign elements should be electrically powered. The sign elements may be light emitting diodes (LEDs) or dot sign units which flip over and are alternately illuminated when flipped over in order to spell out a message on the sign.

Because electrical power may not be available at the site of the hazard or obstruction, the sign should operate off batteries. However, the batteries should also be rechargeable from solar energy because of the limited charge lifetime of any battery. Therefore, the sign should have a solar panel for recharging the batteries.

There is a need for a mobile sign with a solar panel which can be adjusted to the position of the sun without moving the trailer, in order to maximize the ability of the solar panel to charge the batteries.

A mobile highway sign must also have a display that is highly visible under a variety of lighting conditions. Reflected glare from the sun should be minimized while the contrast of the sign's display should be maximized. There is a need for a mobile sign with a display that minimizes reflected glare and at the same time maximizes the contrast of the display.

Heat from the sun may reduce the life of electronic components of the sign and of display elements such as light-emitting diodes (LED). There is a need for a sign with a display which reduces the amount of heat from the sun entering the display.

SUMMARY OF THE INVENTION

The present invention relates to a mobile sign with a solar panel for warning motorists of highway problems. The mobile sign comprises a wheeled vehicle, an electrically powered sign panel mounted on the wheeled vehicle, a chargeable battery for powering the sign panel, and a solar panel for charging the battery. The solar panel is rotatable and tiltable relative to the wheeled vehicle. The sign panel is independently rotatable relative to the wheeled vehicle. The sign panel has a lowglare, high-contrast display that also improves the lifetime of the display's electronic or mechanical components by reducing heating of the display due to the sun.

A principal object and advantage of the present invention is that the sign has a solar panel which is tiltable and rotatable relative to the frame of the wheeled vehicle, thus making it easy to change the angle of the solar panel relative to the sun. The most electricity is generated from a solar panel when the sun's rays are perpendicular to the face of the solar panel. Accordingly, the sign has a solar panel which is tiltable and rotatable relative to the sign and to the wheeled vehicle in order to position the solar panel so that the sun's rays are most nearly perpendicular to it. The optimum position will vary from hour to hour, day to day, and month to month. The sign may be left at the site for a few hours or a few weeks or several months. The position of the solar panel is easily adjustable at whatever frequency makes sense.

Another object and advantage of the present invention is that the position of the solar panel may be adjusted without moving the wheeled vehicle, thereby accommodating situations where the wheeled vehicle cannot be moved because of the presence of other nearby objects.

Another object and advantage of the present invention is that the solar panel is mounted on a mast so that it may be elevated above the sign panel, thereby preventing the sign panel from blocking the sun.

Another object and advantage of the present invention is that the tilting and rotation of the solar panel is accomplished by controls at the level of the standing human operator, thereby making it easy to position the solar panel above the sign panel without a ladder.

Another object and advantage of the present invention is that the solar panel tilts to a completely horizontal position for transport, thus minimizing wind resistance.

Another object and advantage of the invention is that the front face of the display is tilted so as to minimize reflected glare from the sun and to make the display substantially self-shading. The front face of the display is also painted opaque so as to reduce the amount of sunlight entering the display, prolonging the life of electronic components and increasing the contrast of the display.

DETAILED DESCRIPTION OF THE PREFERRED EMBODIMENTS

Figures 1, 4, 5, 6:
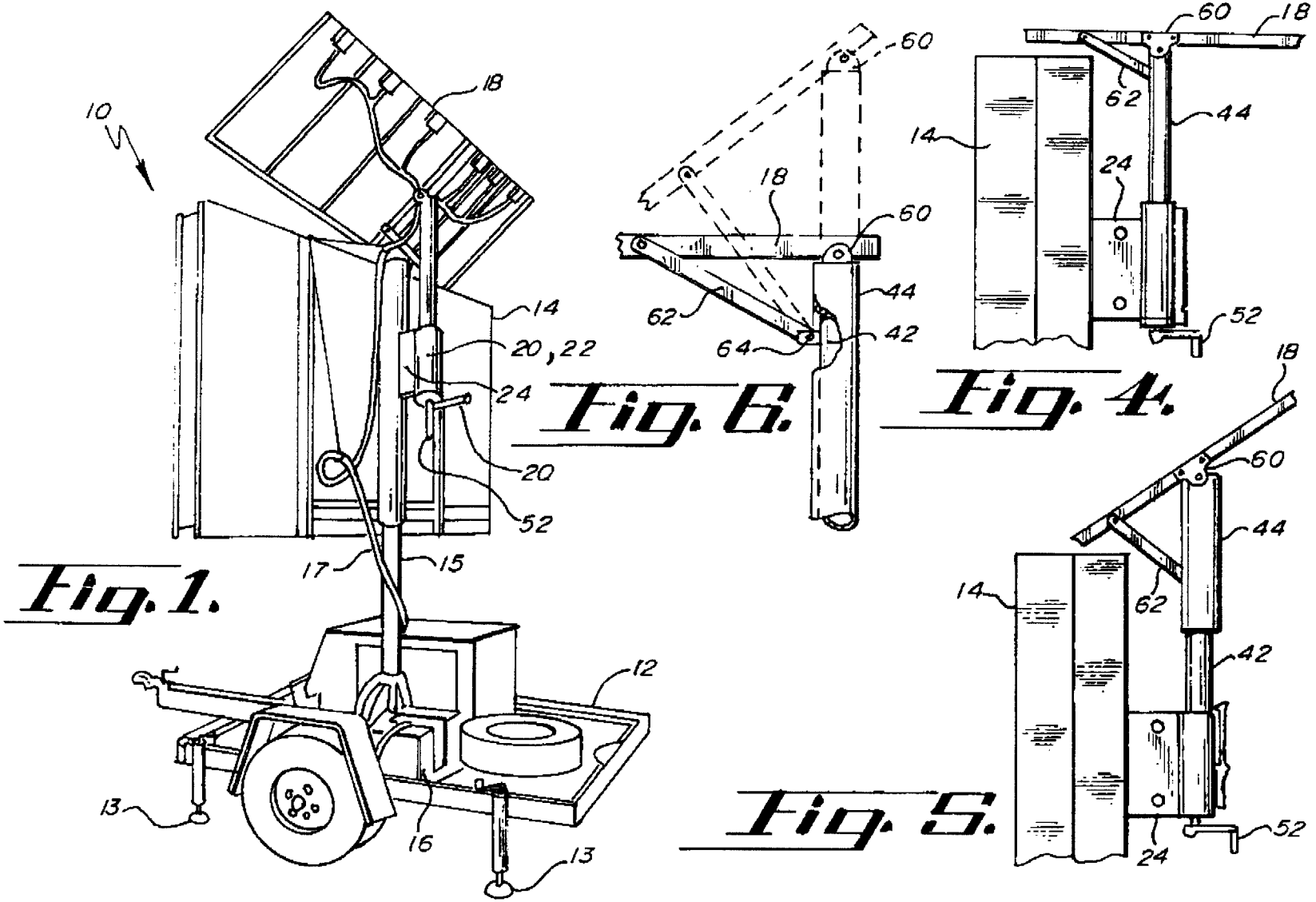
FIG. 1 is a perspective view of the mobile sign with solar panel.
FIG. 4 is a left side elevational view of the solar panel tilted to a horizontal position for transport, with some structure cut away.
FIG. 5 is a left side elevational view of the solar panel tilted above the sign panel for use, with some structure cut away.
FIG. 6 is a left side elevational view of the mechanism which tilts the solar panel, with some structure cut away.

The mobile sign with solar panel of the present invention is generally shown in the Figures by the number 10. The mobile sign with solar panel 10 comprises a wheeled vehicle 12, for example a trailer, for carrying the sign to the place of use, for example along the side of a highway. When the wheeled vehicle 12 reaches the place of use, the wheeled vehicle 12 is positioned relative to oncoming vehicular traffic and the legs 13 are extended, thereby establishing a firm base to support the sign.

The mobile sign with solar panel 10 further comprises an electrically operated sign panel 14 and controls for the sign panel 14. The sign panel 14 is mounted on the wheeled vehicle 12. In the preferred embodiment, the sign panel 14 is mounted on the wheeled vehicle 12 by a first mast 15. The mounting of the sign panel 14 by the first mast 15 is such that the sign panel 14 is rotatable relative to the wheeled vehicle 12, thus allowing the sign panel 14 to be independently positioned to face the oncoming traffic without moving the wheeled vehicle 12. This arrangement accommodates situations in which the wheeled vehicle 12 cannot be moved because of the presence of other nearby objects, or where it is just simpler to rotate the sign. Mounting the sign panel 14 on the first mast 15 also allows the sign panel to be raised to an appropriate height to be visible to vehicular traffic, or lowered onto the wheeled vehicle 12 for transportation.

The sign panel 14 is capable of displaying messages and changing the displayed messages as directed by the operator. Messages may be displayed by means of light-emitting diodes or by dot sign elements which flip over to show a reflective surface. The light-emitting diodes or dot sign elements are generally known as pixels, and are arranged in patterns on the sign 14 so that when the pixels are activated, they form letters of the alphabet, numbers, or other characters.

A chargeable battery 16 on the wheeled vehicle 12 provides power to the sign panel 14 and is connected to the sign panel 14 by appropriate cabling (not shown).

An electricity generating solar panel 18 is connected to the battery 16 by a cable 17 in order to charge the battery 16 during the daylight hours. The sign panel 14 then runs off the battery 16 during night-time hours. The sign panel 14 can also operate off the battery 16 while the battery 16 is being charged.

The mobile sign with solar panel 10 further comprises a means 20 for mounting the solar panel 18 on the wheeled vehicle 12. In the preferred embodiment the means for mounting 20 is a second mast 22, which is mounted on the first mast 15. This arrangement allows the solar panel 18 to be tilted and rotated relative to the wheeled vehicle 12 independently of the rotation of the sign panel 14. Thus, the sign panel may be positioned to face oncoming traffic independently of positioning the solar panel 18 to face the sun.

Figure 2:
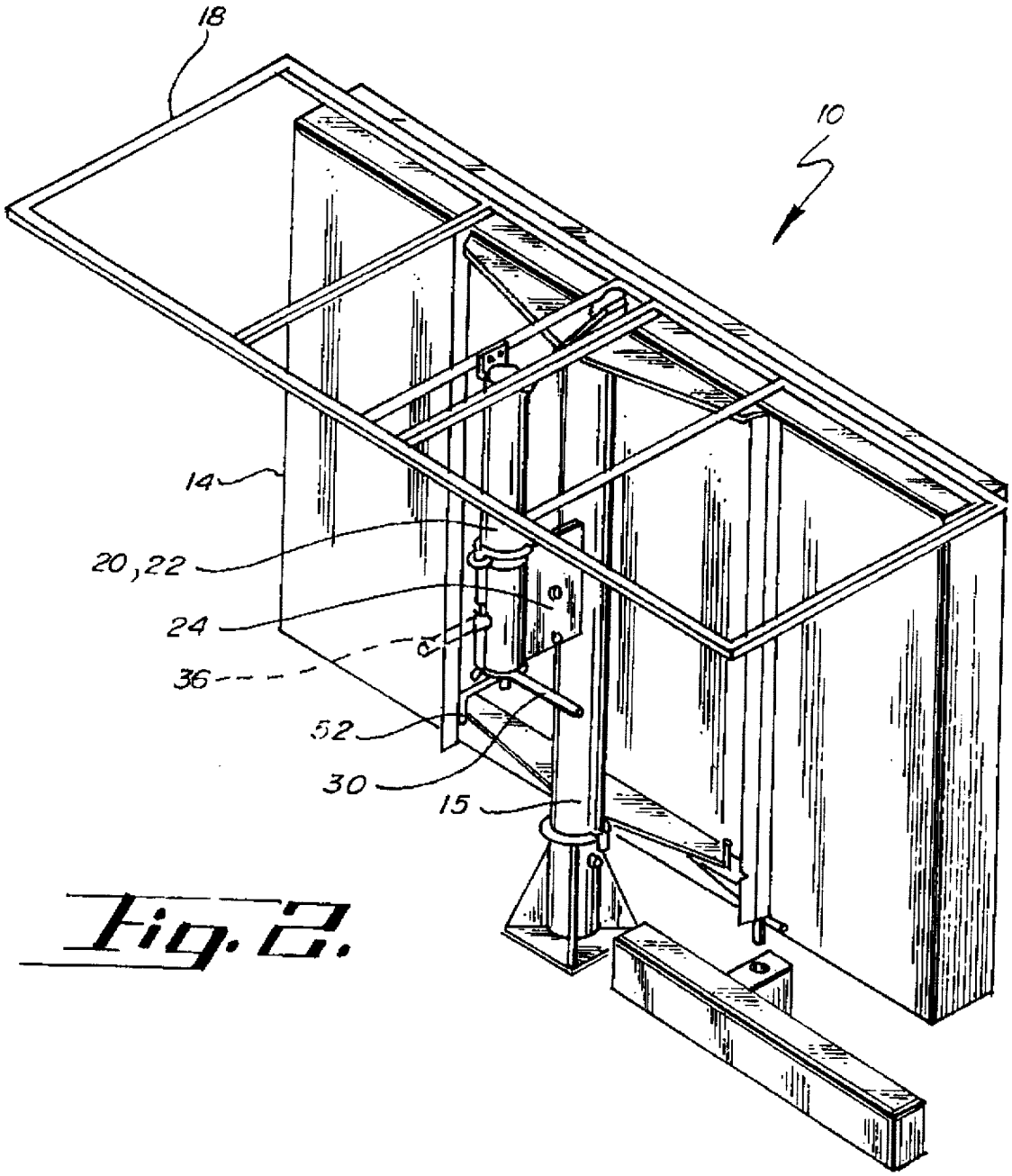
FIG. 2 is another perspective view of the mobile sign with solar panel showing details of the lifting and rotation mechanisms.
Figure 3:
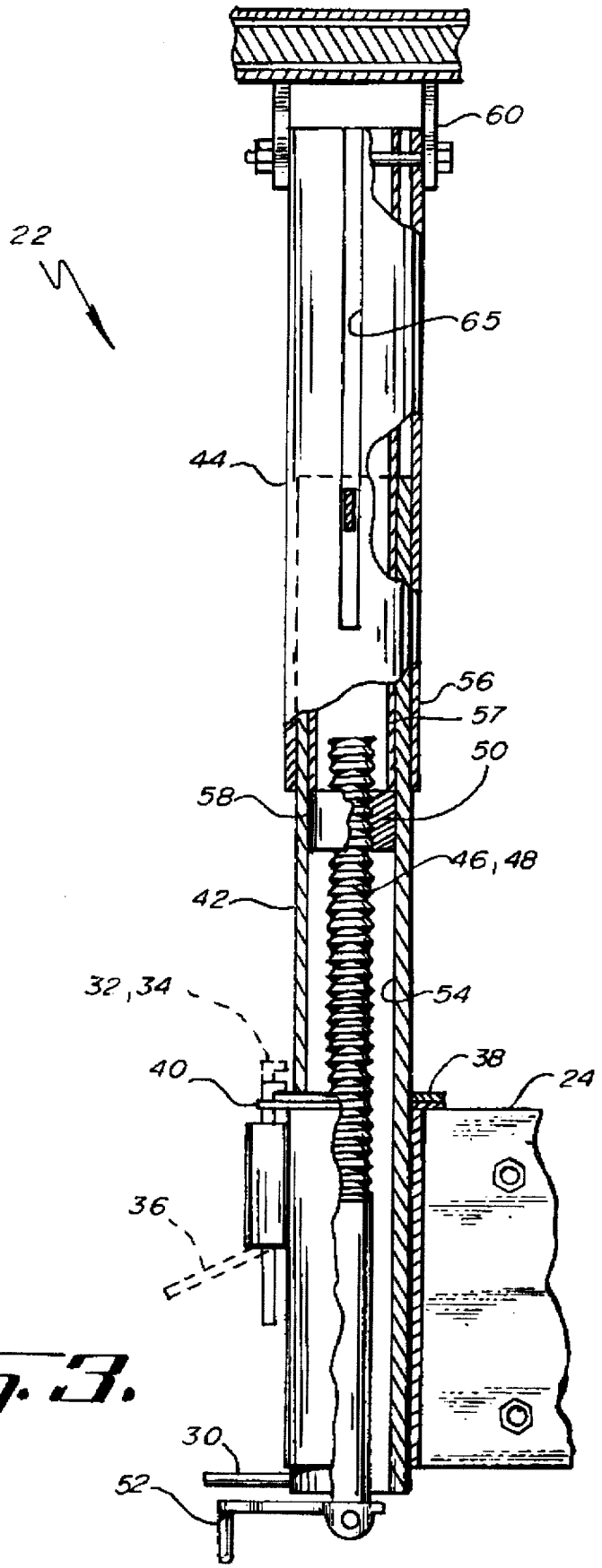
FIG. 3 is a right side elevational view of the mechanism which supports, rotates and tilts the solar panel, with some structure cut away.

As best seen in FIGS. 2 and 3, the second mast 22 further comprises a frame 24 for mounting the second mast 22 to the wheeled vehicle 12, and in particular for mounting the second mast 22 to the first mast 15, which is in turn mounted on the wheeled vehicle 12. The second mast 22 is swingably mounted to the frame 24, allowing the second mast 22 to rotate freely with respect to the frame 24 and wheeled vehicle 12. In the preferred embodiment, the second mast 22 has a flange 38 which rotates against a corresponding flange 40 of the frame 24, thus enabling this swinging movement.

Controls for rotating the sign panel and rotating and tilting the solar panel are conveniently at the level of a standing human operator. The second mast 22 is rotated by the operator by grasping the handle 30 and turning the handle 30 in a clockwise or counterclockwise direction. The solar panel may thus be easily positioned to directly face the sun. Because the most electricity is generated from a solar panel when the sun's rays are perpendicular to the face of the solar panel, the operator may easily rotate the solar panel to track the sun, doing so at whatever frequency makes sense: hourly, daily, or monthly.

Once the solar panel is correctly positioned, the second mast 22 is prevented from rotating further by a brake 32. In the preferred embodiment, the brake 32 consists of a clamp 34 and clamp handle 36. In the unlocked position, shown in phantom in FIG. 3, the clamp handle 36 is raised, lifting the clamp away from the flange 38. When the handle 36 is lowered, the clamp 34 is secured against the flange 38, preventing rotation of the flange 38 against the second flange 40 of the frame. Other equivalents of the brake 32 may of course be employed.

In particular, the second mast 22 comprises a stationary portion 42 mounted to the frame 24 and an extendible portion 44 connected to the stationary portion 42. As best seen in FIG.3, the extendible portion 44 is slidably engaged with the stationary portion 42, thereby allowing the extendible portion 44 to be raised and lowered on the stationary portion 42. As the extendible portion 44 is raised and lowered, the solar panel 18 is tilted, as will be further described below.

The extendible portion 44 is raised and lowered on the stationary portion 42 by a jack 46. In the preferred embodiment, the jack 46 comprises a low-pitch screw 48 and nut 50 and a crank 52 adapted to rotate the screw 48. In this embodiment, the screw 48 rotates within a longitudinal bore 54 within the stationary portion 42, the stationary portion 42 being a hollow tube. The nut 50 is connected to the extendible portion 44. As the crank 52 is turned, the screw 48 rotates, and the nut 50 travels along the screw 48, thus raising or lowering the extendible portion 44 on the stationary portion 42. The low pitch of the screw 48 prevents the weight of the solar panel from rotating the screw, thus keeping the extendible portion raised.

In the preferred embodiment, the extendible portion 44 is also a hollow tube, comprising an outer wall 56 and inner wall 57 spaced from each other and encompassing the wall 58 of the stationary portion 42, the extendible portion 44 thereby sliding longitudinally on the stationary portion 42 in a telescoping fashion.

To enable tilting of the solar panel 18 as the extendible portion 44 is raised and lowered, the solar panel 18 is connected to the extendible portion 44 by a joint 60 and a linkage 62. The solar panel is shown in its lowered portion for transportation in FIG. 4. As can be seen best in FIGS. 5 and 6, raising the extendible portion 44 causes the solar panel 18 to pivot about both the extendible portion 44 and the linkage 62, as the linkage 62 pivots about a bracket 64 fixed to the stationary portion 42. This movement causes the solar panel 18 to tilt upwardly along a single axis, and the rigid linkage 62 prevents the solar panel 18 from contacting the sign panel 14. The solar panel 18 is shown tilted upwardly in FIG. 5. It will be seen that the solar panel 18 may thus be raised above the sign panel 14, thus preventing the sign panel 14 from blocking the solar panel 18 from the sun.

As the extendible portion 44 slides along the stationary portion 42, a longitudinal slot 65 in the extendible portion slides past the linkage 62, thus preventing the linkage 62 from interfering with the motion of the extendible portion 44.

Figure 7:
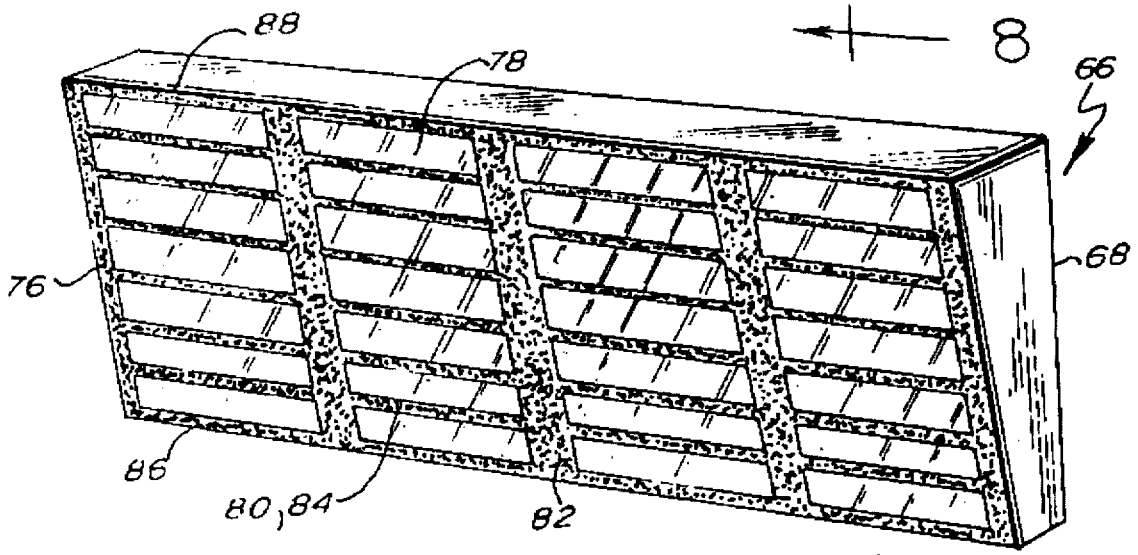
FIG. 7 is a perspective view of the low-glare, high-contrast display used in the mobile sign.
Figure 8:
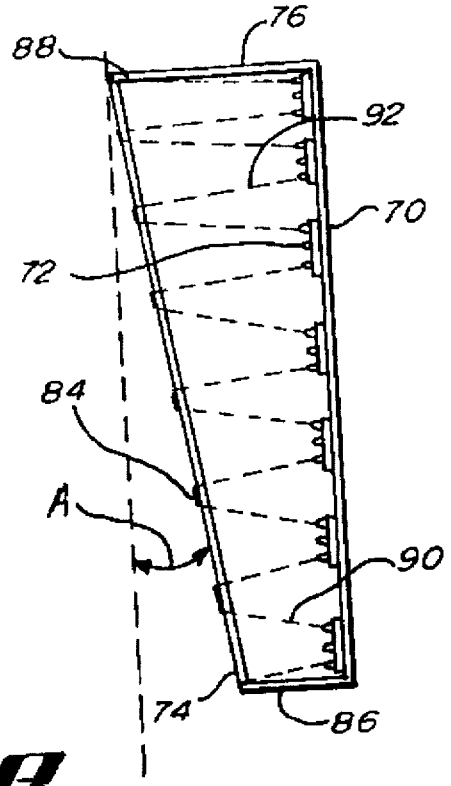
FIG. 8 is a cross-section through the display of FIG. 7 along the lines 8—8.

The mobile sign with solar panel also comprises a high-contrast display 66 for displaying messages to vehicular traffic, as best seen in FIGS. 7 and 8. The front panel 74 of the display 66 protects the display and its support mechanics or electronics by reducing heat within the display 66 caused by sunlight and thus increasing the mean-time-between-failure (MTBF) of the display pixels and electronics. The front panel 74 of the display also produces an improvement in sign contrast.

The high-contrast display 66 comprises a housing 68, which comprises a substantially vertical rear panel 70 having a plurality of changeable message pixels 72. In the preferred embodiment, the pixels 72 are light-emitting diodes (LEDs). The pixels may also be dot sign elements that flip over to show a reflective surface.

The front panel 74 is made of a transparent and substantially rigid material such as Lexan®. Lexan® is a registered trademark of the General Electric Co. for polycarbonate plastics. The front panel 74 is spaced from the rear panel and the bottom edge 86 is closer to the rear panel 70 than the top edge 88, and the front panel 74 is therefore tilted downwardly relative to the rear panel 70 at an angle A in the range of 5 degrees to 10 degrees, preferably 7 degrees. The tilted front panel 74 reflects light from the sun towards the ground and away from oncoming traffic, thus minimizing the glare seen by drivers and increasing the visibility of the display. The tilted from panel 74 also decreases heating of the display by reflecting sunlight. The tilted display also decreases heating from the sun by making the display substantially self-shading when the sun is highest, in that the top panel 76 of the display 66 projects substantially outwardly and will shade the pixels 72 and other electronics when the sun is at a high angle.

The display 66 also comprises a substantially non-reflective pattern 76 on the front panel 74. In the preferred embodiment, the pattern 76 is painted on the front surface of the front panel 74, as by silk-screening or other method. As best seen in FIG. 7, the pattern 76 comprises a multiplicity of windows 78 and opaque zones 80. The windows 78 permit light from the message pixels 72 to pass through the front panel 74. The opaque zones reduce the amount of sunlight entering the display, thus reducing heat within the display and further protecting the mechanical and electronic elements. Because the pattern 76 is on the front surface of the front panel 74, and is non-reflective, reflected glare is also reduced. Furthermore, the pattern 76 breaks up the front panel 74 into multiple surfaces, further reducing reflected glare. The pattern 76 also improves the contrast of the display 66.

In the preferred embodiment, the opaque zones 80 comprise vertically extending opaque areas 82 and horizontally extending opaque areas 84, thus producing a pattern 76 with rows and columns, as seen in FIG. 7. The message pixels 72 are also arranged in rows and columns on the rear panel 70, corresponding to the windows 78 between opaque zones 80.

As can be seen in FIG. 7, the height of the horizontally extending opaque areas 84 progressively decreases from the bottom edge 86 of the front panel 74 towards the top edge 88 of the front panel 74. The purpose of this arrangement is to accommodate the tilt of the front panel 74 and maximize the light from the pixels 72 passing through the front panel 74. As can be appreciated from FIG. 8, near the bottom edge 86 of the panel 74, the front panel 74 is nearly parallel and close to the rear panel 70 and the pixels 72. Consequently, light rays 90 from the pixels 72 do not spread out very much before they reach the front panel 74. Therefore, the windows 78 near the bottom edge 86 of the front panel 74 need be no larger than the extent of the corresponding pixels 72, and the height of the horizontally extending opaque areas between windows can be large. However, near the top edge 88 of the front panel 74, the front panel is angled to and substantially further from the rear panel 72. Consequently, light rays 92 from pixels 72 have substantially spread out as they reach the front panel 74. Furthermore, the tilt of the front panel 74 near the top edge 88 changes the viewing angle of the pixels. For these reasons, the windows 78 near the top edge 88 of the front panel 74 must be larger than the corresponding extent of the pixels 72, and therefore, the height of the horizontally extending opaque areas 84 between the windows 78 must be less.

It has been found that the combination of a tilted front panel 74 and a pattern 76 painted on the front panel 74 also produces unexpected improvement in terms of sign contrast. By minimizing glare and providing opaque areas 80, the visibility of the message pixels 72 is substantially improved.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A mobile sign with solar panel for directing messages to vehicular traffic on a highway, comprising:

a wheeled vehicle for carrying the sign, an electrically powered sign panel and controls thereof said electrically powered sign panel and controls are mounted on said wheeled vehicle, for displaying messages and changing the displayed messages, a chargeable battery on the wheeled vehicle for powering said sign panel and connected to said sign panel, an electricity generating solar panel connected to said battery for charging said battery, means for mounting said solar panel on said wheeled vehicle, and means for tilting and rotating said solar panel relative to said wheeled vehicle for orienting said solar panel to directly face the sun, said sign panel being rotatable relative to said wheeled vehicle, said means for tilting and rotating said solar panel operating independently of the rotation of said sign panel.

2. A mobile sign with solar panel as in claim 1, further comprising a first mast for mounting said sign panel on said wheel vehicle.

3. A mobile sign with solar panel as in claim 2, wherein said means for mounting said solar panel on said wheeled vehicle comprises a second mast.

4. A mobile sign with solar panel as in claim 3, wherein said second mast is mounted on said first mast.

5. A mobile sign with solar panel for directing messages to vehicular traffic on a highway, comprising:

a wheeled vehicle for carrying the sign, an electrically powered sign panel and controls thereof for displaying messages and changing the displayed messages, a first mast mounting said sign panel on said wheeled vehicle, said first mast being adapted to raise, lower, and rotate said sign panel relative to said wheeled vehicle, a chargeable battery on said wheeled vehicle for powering said sign panel and connected to said sign panel, an electricity generating solar panel connected to said battery for charging said battery, and a second mast mounting said solar panel on said wheeled vehicle, said solar panel being connected to said second mast and said second mast being adapted to tilt and rotate said solar panel relative to said wheeled vehicle.

6. A mobile sign with solar panel as in claim 6, wherein said second mast further comprises:

a frame mounting said second mast on said wheeled vehicle, a stationary portion of said second mast and an extendible portion of said second mast connected to said stationary portion and said extendible portion being adapted to tilt said solar panel relative to said second mast, said stationary portion being swingably connected to said frame, said extendible portion being slidably engaged with said stationary portion, a handle adapted to rotate said second mast, a brake for preventing rotation of said second mast, and a jack adapted to raise and lower said extendible portion on said stationary portion to tilt said solar panel.

7. A mobile sign with solar panel as in claim 6, wherein said stationary portion further comprises a hollow tube with a wall and a longitudinal bore therein, said jack further comprises a low-pitch screw and nut and a crank adapted to rotate said screw, and said screw rotates within said bore, said nut being connected to said extendible portion so as to raise and lower said extendible portion as said screw rotates.

8. A mobile sign with solar panel as in claim 7, wherein said extendible portion further comprises a hollow tube with an outer wall and inner wall spaced from each other and encompassing the wall of said stationary portion therebetween, and said extendible portion thereby slides longitudinally on said stationary portion.

9. A mobile sign with solar panel as in claim 6, wherein said second mast further comprises a joint connecting said solar panel to said extendible portion and a linkage connecting spaced portions of said solar panel with said stationary portion, said joint and said linkage being adapted to allow said solar panel to tilt along one axis without contacting said sign panel as said extendible portion is raised and lowered, said extendible portion further comprising a longitudinal slot which slides past said linkage as said extendible portion slides on said stationary portion.

10. A mobile sign with solar panel as in claim 5, wherein said solar panel can be tilted above said sign panel.

11. A mobile sign with solar panel as in claim 5, wherein said solar panel can be tilted to a horizontal position for transport.

12. A mobile sign with solar panel for directing messages to vehicular traffic on a highway, comprising:

a wheeled vehicle for carrying the sign, an electrically powered sign panel and controls thereof said electrically powered sign panel and controls are mounted on said wheeled vehicle, for displaying messages and changing the displayed messages, a chargeable battery on the wheeled vehicle for powering said sign panel and connected to said sign panel, an electricity generating solar panel connected to said battery for charging said battery, means for mounting said solar panel on said wheeled vehicle, means for tilting and rotating said solar panel relative to said wheeled vehicle for orienting said solar panel to directly face the sun, and a first mast for mounting said sign panel on said wheeled vehicle.

* * * * *

UNITED STATES PATENT AND TRADEMARK OFFICE

CERTIFICATE OF CORRECTION

PATENT NO. : 5,542,203

DATED : August 6, 1996

INVENTOR(S) : Eugene H. Luoma and James L. Blesener

It is certified that error appears in the above-indentified patent and that said Letters Patent is hereby corrected as shown below:

Column 1, line 6, before the word "invention" please insert --The present--.

Signed and Sealed this

Tenth Day of December, 1996

*Attest:*

Bruce Lehman

BRUCE LEHMAN

*Attesting Officer*

*Commissioner of Patents and Trademarks*